United States Patent [19]

Forbus

[11] Patent Number: 4,762,635

[45] Date of Patent: Aug. 9, 1988

[54] HIGH TRACTION SYNTHETIC HYDROCARBON FLUIDS

[75] Inventor: Thomas R. Forbus, Newtown, Pa.

[73] Assignee: Mobil Oil Corporation, New York, N.Y.

[21] Appl. No.: 888,915

[22] Filed: Jul. 24, 1986

[51] Int. Cl.[4] ..... C10M 101/02

[52] U.S. Cl. ..... 252/73; 252/9; 252/11; 585/10; 585/18; 585/250; 585/255; 585/276; 585/507

[58] Field of Search ..... 252/9, 11, 73; 585/10, 585/18, 250, 255, 276, 507

[56] References Cited

U.S. PATENT DOCUMENTS 3,608,385 9/1971 Duling et al. ..... 252/73

3,959,161 5/1976 Dawans et al. ..... 585/10

4,122,023 10/1978 Yasui et al. ..... 585/255

4,482,771 11/1984 Bozzelli et al. ..... 585/10

FOREIGN PATENT DOCUMENTS 975723 11/1982 U.S.S.R. ..... 585/255

*Primary Examiner*—Robert Wax

*Attorney, Agent, or Firm*—Alexander J. McKillop; Michael G. Gilman; Howard M. Flournoy

[57] ABSTRACT

Highly branched synthetic hydrocarbon fluids produced by anionically oligomerizing selected dienes in the presence of organoalkali compounds and complexing reagents provide fluids having high traction coefficients and excellent elastohydrodynamic lubricating characteristics.

10 Claims, No Drawings

HIGH TRACTION SYNTHETIC HYDROCARBON FLUIDS

CROSS-REFERENCE TO RELATED APPLICATIONS

This application is related to Ser. No. 888,900 entitled Synthetic Hydrocarbon Lubricating Fluids, filed July 24, 1986, and now pending and also to Ser. No. 814,427 entitled Synthetic Hydrocarbon Lubricating Fluids, Filed Dec. 30, 1985, and now abandoned, and to Ser. No. 015,524 which is a continuation of Ser. No. 814,427, filed Feb. 11, 1987, and now pending.

BACKGROUND OF THE INVENTION

This invention relates to highly branched synthetic hydrocarbon fluids (SHF) produced by non-destructively hydrogenating anionically oligomerized dienes or polydienes, having utility as traction fluids and to a method of operating traction drives using the described synthetic hydrocarbon fluids.

High traction fluids give superior performance in traction drives. A traction drive transfers force from one rotating shaft to another through a rolling contact. The transfer is efficient if there is "minimal" slippage. This is a function of the traction coefficient which is defined as the force transmitted divided by the normal force which keeps the rolling members in contact or as being the quotient of the traction due to the transmission of the traction between the driving and driven elements and the normal force (normal load) between the driving and driven elements. Slip may be defined as being the absolute value of the quotient of the difference between the two circumferential speeds of the roller elements and the greater circumferential speed. The maximum coefficient of traction is preferably as high as possible in order to achieve maximum power transmission per unit load.

Various fluids have been proposed and/or utilized as traction fluids. For example, U.S. Pat. No. 3,411,369 discloses fluids comprising fused, saturated carbon containing rings; U.S. Pat. No. 3,440,894 discloses fluids comprising organic compounds containing a saturated carbon containing ring or an acyclic structure having at least three quaternary carbon atoms; U.S. Pat. No. 4,499,000 discloses power-transmission fluids containing cyclic ketals derived from alicyclic ketones. Generally speaking, the prior art generally used mineral oils as the lubricant basestock or were limited to synthetic fluids having low viscosity grades.

It has now been discovered that synthetic hydrocarbon fluids with high traction coefficients throughout a wide range of viscosity grades are obtainable from the hydrogenation of highly branched (large amounts of 3,4-enchainment) isoprene oligomers. These fluids have traction coefficients equivalent to or higher than traction fluids currently commercially marketed. Additionally, they show better performance in terms of lubricant protection in elastohydrodynamic lubrication (EHL-)—the mode of lubricating in which traction drives operate. These hydrogenated polyisoprene (HPI) fluids can be produced in any viscosity grade. The highly branched synthetic hydrocarbon fluids of the present invention, to the best of applicant's knowledge, have not previously been used as fluids for traction drive applications.

SUMMARY OF THE INVENTION

This invention is directed to a method of transmitting torque or tractional forces from a tractional driving element to a driven element through a traction fluid comprising using as said traction fluid a composition comprising a highly branched synthetic hydrocarbon fluid having high traction coefficient and excellent elastohydrodynamic lubricating capabilities prepared by the non-destructive hydrogenation of anionically oligomerized dienes which were synthesized in the presence of minor amounts of an organoalkali metal compound and a complexing reagent. The invention is also directed to an improved method of operating a traction drive wherein the improvement comprises using as the traction fluid a highly branched synthetic hydrocarbon fluid having a high traction coefficient and excellent elastohydrodynamic lubricating ability prepared by the non-destructive hydrogenation of anionically oligomerized dienes or polydienes prepared in the presence of minor amounts of an organoalkali metal compound and a complexing reagent therefor.

DESCRIPTION OF SPECIFIC EMBODIMENTS

The highly branched synthetic hydrocarbon fluids embodied herein are produced by hydrogenation of anionically oligomerized dienes or polydienes such as isoprene using organoalkali metal reagents (e.g., alkyllithium) in a suitable complexing reagent and/or solvent. The oligomerization reactions are stoichiometric and give near quantitative yields of oligomers.

Branching, derived from 3,4-enchainment of the selected oligomers is controlled primarily by the complexing reagent, reaction temperature and ratio of reactants. Tetrahydrofuran is an example of a highly suitable complexing reagent although other reagents which complex organoalkali metals will achieve similar results. The complexing reagent is used in an amount sufficient to achieve 50–85% and preferably a minimum of 75–80% or more 3,4-enchainment of the oligomers. Substantially 1:1 stoichiometry of organoalkali metal reagent and the complexing reagent achieves the desired 3-4- structure in the oligomers. Low temperatures from about −15° C. to about 30° C. favor increased 3,4-enchainment, although slightly higher temperatures of up to 50°–70° C. may be used.

The hydrogenated (poly)diene fluids in accordance with the invention can be conveniently produced in a wide range of viscosities and their structures can be tailored to produce a wide range of traction properties. The molecular structure produced in these fluids influences their traction properties. In general, highly-branched structures have high traction. The traction properties are thus also controlled by the monomer used to produce the hydrogenated polydiene fluid as well as the branching from variable enchainment ratios.

Elastohydrodynamic film thicknesses generated by these fluids are significantly larger than mineral oils and other synthetic hydrocarbon fluids at equivalent viscosities. Traction coefficients are as high or higher than commercially available synthetic hydrocarbon fluids designed for use as traction fluids. The synthetic fluids in accordance with the present invention generally have traction coefficients ranging from about 0.090° to about 0.120 ° at 90° C. and 400 K psi contact pressure.

Due to the "living" nature of the oligomerization process, molecular weight of the diene oligomers and the resulting viscosity of their nondestructively hydrogenated products is easily controlled by the anionic synthesis. Fluids of any desired viscosity can be produced simply by control of the reactant ratios in this stoichiometric reaction.

In addition, due to the nature of the oligomerization process, diene oligomers of a variety of microstructures can be achieved and retained in the hydrogenation step. The reaction medium has a profound influence on the microstructure of the oligomers. Structures with greater alkyl branching are obtained by oligomerization in the presence of complexing reagents such as tetrahydrofuran (THF) followed by hydrogenation. This results from a dramatic increase in the selectivity towards 3,4-enchainment in the oligomerization. The increased alkyl branching, relative to the ethylene-propylene oligomers EPO type structures derived mainly from 1,4-enchainment, at equivalent molecular weight, are a dramatic increase in viscosity and a dramatic decrease in VI. The microstructure of the hydrogenated diene oligomers has great influence on:

1. Viscosity index (VI)
2. Elastohydrodynamic (EHD) film thickness as function of viscosity and temperature and
3. Traction properties in EHD lubrication.

Lubricants based upon the disclosed hydrogenated polydienes can accordingly be produced with many desirable properties tailored to meet specific lubrication applications. The structure of these fluids can be easily controlled in the synthesis of the polydiene precursors to achieve the desired properties in the hydrogenated products. No other process for producing lubricating fluids with such diversity and versatility has been reported or is known to applicant.

There is a multitude of patented designs for continuously variable transmissions (CVT's) of which approximately ten of the "traction drive" type have been commercialized. CVT's can be used to give a wide range of output speeds for a single input speed, which is a useful feature for industrial drives, or to allow automotive engine speed to be selected for maximum efficiency based upon required torque rather than required output speed, which could potentially improve fuel economy by up to 30%.

A traction drive may be considered a transmission without gear teeth. The torque is transmitted through the thin elastohydrodynamic lubricant (EHL) film generated between the rolling elements of the drive; and since there are no teeth, the ratio need not be fixed and can be designed to vary continuously. Fluids appropriate for traction drives are those which have high shear strength at the high contact pressures encountered in EHL contacts. The maximum torque that can be transmitted is determined by the fluid's peak traction coefficient (traction force divided by contact load), which is proportional to the fluid's shear strength at the contact pressure and temperature.

The contact load required for a given torque can be reduced by using fluids with a high traction coefficient. This in turn contributes to longer roller fatigue life which is inversely proportional to the third power of the load. Suitable fluids, known as traction fluids, must be able to lubricate the rollers in addition to transmitting torque. Traction drives are usually operated at high speed to maximize power (torque×speed) for a given torque and low viscosity fluids are used to reduce churning losses and heating.

Traction force is the response of the fluid to the strain or strain rate caused by small speed differences between the bounding surfaces of an EHL contact. At the high pressures encountered, many lubricants behave as elastic-plastic solids rather than viscous liquids and the highest traction force that can be generated is a function of the maximum shear stress the solidified fluid can sustain before plastic strain occurs.

From traction force measurements in a point contact traction rig, an average value of the maximum shear stress is determined for a fluid at a range of pressures. Plots of maximum average shear stress against pressure have been found to be linear at high pressures for most fluids studied so far and for the high traction fluids remain linear throughout the pressure range used. Linearity of such a plot is a characteristic of plastic materials sheared under compression.

For purposes of comparing the performance of these fluids in traction drives, it is perhaps easier to think in terms of the traction coefficient (traction force divided by contact load). Table 1 gives values of traction coefficient determined at 90° C. and two maximum contact pressures of 250 kpsi and 400 kpsi for a range of fluids. The HPI fluids have substantially greater traction coefficients than naphthenes and paraffinic mineral oils and PAO. The HPI fluids also have traction coefficients equivalent to or higher than commercial traction fluids.

These HPI fluids have also been found to be able to generate thicker EHL (elastohydrodynamic lubrication) films than other fluids or similar viscosity. To what degree depends upon their molecular structure. The highly branched hydrogenated polyisoprenes (HPI) which result from increased 3,4-enchainment in the oligomerization step, show greater film thickness. This is the result of greater increase in viscosity with pressure (higher pressure-viscosity coefficients) for these fluids as branching increases. The physical benefits are either greater EHL film thickness at equivalent viscosity, giving more protection in rolling bearings and gears, or equivalent EHL film thickness at substantially reduced viscosity leading to increased energy efficiency due to reduced churning losses.

Elastohydrodynamic lubrication is the regime of lubrication whereby the elastic deformation of non-conforming, contacting surfaces plays a major role in the generation and maintenance of hydrodynamic, load-carrying film which maintains separation of the surfaces. This is the mode of lubrication of gears, rolling bearings, cams and traction drives. They operate at very high contact pressures (up to 400,000 psi) and the increase in viscosity with pressure of lubricating fluids is vital to the protective film formation.

The sole lubricant contribution to EHL film thickness is summed up as LP, the lubricant parameter. LP is a product of the dynamic viscosity, $\eta$, (cP), and the pressure-viscosity coefficient, $\alpha$, ($psi^{-1}$), defined by the equation:

$$LP = 14500\eta\alpha$$

For a given component, speed, load and operating temperature, film thickness and protection can be increased by increasing $\eta$ or $\alpha$. Increasing $\eta$ causes increased churning losses and higher operating temperatures. Increasing $\alpha$ is consequently better. This presumably has been ignored in the past because $\alpha$ is a function of $\eta$ for related types of mineral oils.

In practice LP is determined by measurement of EHL film thickness as a function of rolling speed at constant temperature (and thus viscosity), load and contact geometry. By determining LP as a function of temperature, a fluid's EHL behavior can be fully characterized. In addition the equivalent pressure-viscosity coefficients, $\alpha$, can be calculated. Such analyses result in logarithmic relationships between absolute viscosity and lubricant parameter which are functions of fluid structure. Paraffinic mineral oils, naphthenic mineral oils, polyalphaolefins, as well as other general structural classes of fluids generally have single characteristics relationships between LP and absolute viscosity. Thus it seems likely that SHF of different molecular structure would show variable behavior of LP with viscosity. This would result from variable pressure-viscosity behavior as a function of molecular structure.

Increased branching in HPI fluids gives higher pressure-viscosity coefficients and higher lubricant parameter (LP) values with viscosity. EHL film thicknesses at equivalent viscosities can be up to 2.7 times that of PAO fluids depending upon structure.

The HPI fluids of the present invention have increasing pressure-viscosity coefficient ($\alpha$) with increased branching. Higher $\alpha$ values for HPI fluids result in significantly higher LP values and EHL film thickness than for PAO fluids of similar viscosity.

The oligomerization may be carried out under any suitable set of reaction conditions which will ensure the particularly desired polymeric product from substantially pure streams of conjugated diene.

In accordance with the present invention, an anionic polymerization initiator is selected from the group consisting of organo-alkali metal compounds.

The organo-alkali metal compound is suitably selected from the group consisting of organo-lithium compounds, organo-sodium compounds and organo-potassium compounds. The organo-portion of the organo-alkali metal compound is suitably selected from the group consisting of alkyl radicals having from one to ten carbon atoms per alkyl group, alkylaryl radicals having only one alkyl substituent and from 7 to 12 carbon atoms per alkylaryl group, and aryl radicals selected from the group consisting of phenyl, biphenyl, napththyl and diphenylmethyl radicals. The organo-portion is preferentially an alkyl radical having from one to six carbon atoms per radical.

The organo-alkali metal compound or reagent is preferably an organo-lithium compound selected from the group consisting of methyllithium, ethyllithium, propyllithium, isopropyllithium, n-butyllithium, t-butyllithium, sec-butyllithium, t-octyllithium, n-decyllithium, phenyllithium, naphthyllithium, 4-butylphenyllithium, p-tolyllithium, 4-phenylbutyllithium, cyclohexyllithium, 4-butyl-cyclohexyllithium, 4-cyclohexyl-butyllithium, and the like. The organo-alkali metal compound is preferably $C_1$–$C_{10}$ alkyl and more preferably n-butyllithium. It is understood that organopotassium or organosodium compounds may also be used.

The solvent is preferably selected from any suitable organic solvent which has alkali metal complexing capabilities. Suitable solvents are chosen on the basis of whether they are complexing agents. These solvent-/complexing agents include solvents, such as ethers, amines, sulfides, and pyridines. Preferred include diethyl ether, tetrahydrofuran, dioxane, methyltetrahydrofuran, and the like. Tetrahydrofuran is the preferred solvent.

The dienes which are suitable for use in accordance herewith are selected from any appropriate 1,3-diene. In general conjugated dienes having from 4 to 6 carbon atoms per molecule as, for example, 1,3 butadiene or 2-methyl 1,3-butadiene (isoprene) are preferred.

In the oligomerization, substantially stoichiometric amounts of diene, complexing reagent (THF) and initiator (n-butyl lithium) are used. A slight excess of THF may, however, be used if desired. Preferably a 5:1 or more (diene to initiator) molar ratio of the reactants is used at temperatures of about 10° to about 120° C. for up to 10 hours or more preferably 1 to 3½ hours at autogenous pressure. Hydrogenation is carried out in any convenient manner known in the art. Generally, neat or in hydrocarbon solvent solution, e.g., hexane, over a transition metal catalyst such as nickel on Kieselguhr in a ratio of catalyst to oligomerized diene of from about 0.5–1 to about 100 at temperatures of from about 150°–250° C. and pressures from about 300–700 psi hydrogen. The hydrogenation is non-destructive, i.e., saturates the olefinic bonds while retaining the branching structure produced in the oligomerization. The microstructure and molecular weight of the oligomers are retained in the hydrogenation process. Complete hydrogenation is accomplished without cracking or rearrangement.

The following exemplary matter is merely illustrative and is not intended as a limitation.

EXAMPLES 1 to 10

Oligomers of isoprene of varied microstructure were synthesized by addition of the isoprene to the concentrated n-butyl lithium solutions (1.6–10.1 molar ratio) in hexane under a blanket of dry nitrogen. Tetrahydrofuran (THF) was used as complexing reagent in 0.5–32 molar ratio of THF to n-butyl lithium for branching control in the oligomers. The solutions of the polyisopropenyl lithium were quenched by water. The diene oligomers were isolated by removal of solvent. Yields approached quantitative within the limits of the experimental methods. Table 1 gives reactant proportions and reaction temperatures at atmospheric pressure.

The diene oligomers were hydrogenated neat or as up to 50 wt.% solutions in hexane over nickel or Kieselguhr (1 g catalyst/100 g diene) at 180°–250° C. at 600 psi hydrogen. The synthetic hydrocarbon fluids were isolated by filtration followed by removal of solvent. Yields approached quantitative within the limits of the experimental methods.

Traction measurements were made on a ball-on-plate traction apparatus. Peak traction coefficients were determined in the temperature region of 30°–120° C. at maximum contact pressures (stresses) from 100–425 Kpsi. Traction coefficients of the HPI fluids and other common lubricating fluids are shown in Table 2 (90° C., 250 and 400 Kpsi).

Lubricant parameter (LP) values for the selected HPI fluids were determined as a function of temperatures on an optical EHL viscometer from film thickness variation with rolling speed at various temperatures. Pressure-viscosity coefficient ($\alpha$) and LP values at 100° C. are shown in Table 2.

TABLE 1

| | Polyisoprene Synthesis Parameters | | | | |
|---|---|---|---|---|---|
| HPI Example | Mol Isoprene | Mol n-BuLi | Mol THF | Rx T °C. | Mol Ratio THF:n-BuLi |
| 1 | 2.94 | 0.62 | 0.72 | 25 | 1.16 |
| 2 | 2.94 | 0.78 | 1.23 | 25 | 1.58 |
| 3 | 2.94 | 0.78 | 1.23 | 40 | 1.58 |
| 4 | 15.0 | 4.04 | 6.15 | −10 | 1.52 |
| 5 | 15.0 | 3.03 | 14.8 | −15 | 0.99 |

TABLE 1-continued

| HPI Example | Polyisoprene Synthesis Parameters: Mol Isoprene | Mol n-BuLi | Mol THF | Rx T °C. | Mol Ratio THF:n-BuLi |
|---|---|---|---|---|---|
| 6 | 1.59 | 0.16 | 0.62 | 25 | 3.88 |
| 7 | 1.47 | 0.15 | 0.074 | 65 | 0.5 |
| 8 | 1.91 | 0.18 | 0.62 | 25 | 3.4 |
| 9 | 14.7 | 2.15 | 14.8 | 25 | 31.6 |
| 10 | 1.91 | 0.27 | 1.84 | 20 | 6.8 |

TABLE 2

| Description | EHL and Traction Properties of Fluids: Dynamic Viscosity cP 100° C. | Pressure-Viscosity Coefficient (100° C.) $\times 10^{-4}(psi)^{-1}$ | Lubricant Parameter LP 100° C. | Peak Traction Coefficient (90° C.) 250 kpsi* | 400 kpsi* | VI |
|---|---|---|---|---|---|---|
| 1. Commercial Traction Fluid** | 4.9 | * | 5.5 | 0.101 | 0.103 | 125 |
| 2. Naphthenic Mineral Oil | 7.8 | 1.16 | 13.2 | 0.069 | 0.076 | 63 |
| 3. Paraffinic Mineral Oil | 6.0 | 1.02 | 8.9 | 0.052 | 0.068 | 106 |
| 4. Polyalphaolefin (PAO) | 4.3 | 0.86 | 5.4 | 0.037 | 0.050 | 136 |
| HPI, Example 1 | 4.5 | 1.25 | 8.1 | 0.087 | 0.095 | 50 |
| HPI, Example 2 | 5.5 | 2.10 | 16.6 | 0.092 | 0.096 | 20 |
| HPI, Example 3 | 4.7 | 2.10 | 14.2 | 0.087 | 0.092 | 25 |
| HPI, Example 4 | 4.5 | 1.58 | 10.3 | 0.085 | 0.090 | 10 |
| HPI, Example 5 | 7.3 | 1.62 | 17.1 | 0.103 | 0.110 | 16 |
| HPI, Example 6 | 19.4 | 1.19 | 33.3 | 0.063 | 0.075 | 122 |
| HPI, Example 7 | 23.2 | 1.90 | 63.8 | 0.082 | 0.088 | 55 |
| HPI, Example 8 | 21.6 | 2.35 | 73.5 | 0.095 | 0.100 | −19 |
| HPI, Example 9 | 20.1 | 2.99 | 87.3 | 0.107 | 0.113 | −32 |
| HPI, Example 10 | 21.0 | 2.67 | 81.5 | 0.110 | 0.120 | −58 |

*Maximum Hertzian Contact Stress.
**Monsanto SANTOTRAC ® 50
1. Montsanto SANTOTRAC 50—a polydimethylsiloxane with a viscosity of 4.9 centipoises at 100° C. and a typical pour point of −40 to −45° F.
2. Mineral oil containing a preponderance of naphthenic compounds with a viscosity of 7.8 centipoises at 100° C. and a typical pour point of 0 to −20° F.
3. Mineral oil containing a preponderance of paraffins with a viscosity of 6.0 centipoises at 100° C. and a typical pour point of 10 to −20° F.
4. Poly alpha-olefin mixture with a viscosity of 4.3 centipoises at 100° C. and a typical pour point of −40 to −45° F.

The data disclosed herein clearly show that relative to other common types of lubricating fluids, the HPI fluids in accordance with the present invention have:

1. Equivalent or better lubricant protection.
2. Equivalent or higher traction coefficients.
3. Superior pressure-viscosity properties which will result in substantially larger film thicknesses at any given viscosity.

These superior properties of HPI fluids result in:

1. Equivalent lubricant protection at substantially lower viscosity or better protection at equivalent viscosity;
2. Reduced viscous churning losses for equivalent lubricant protection resulting in better energy efficiency, lower operating temperatures and concomitant longer lubricant life.
3. Better performance in traction drive applications.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A method of making highly branched synthetic dhyrocarbon traction drive fluid having a high traction coefficient and excellent elastohydrodynamic lubricating characteristics comprising anionically oligomerizing dienes or polydienes in the presence of substanially 1:1 molar amounts of an organo-alkali metal compound or mixture thereof and a complexing reagent at autogenous pressure and temperatures ranging from 10 to about 120° C., and thereafter non-destructively hydrogenating the resultant oligomers, the oligomerized dienes or polydienes having at least 50–85% 3,4-enchainment.

2. The method of claim 1 wherein said oligomerized dienes have at least 75–80% 3,4-enchainment.

3. The method of claim 1 wherein said diene is isoprene.

4. The method of claim 1 wherein the organoalkali metal compound is selected from the group consisting of organo-sodium, organo-lithium and organo-potassium compounds.

5. The method of claim 1 wherein said diene or polydiene is anionically oligomerized in the presence of minor amounts of a $C_1$–$C_{10}$ alkyllithium compound and a complexing reagent.

6. The method of claim 5 wherein said complexing reagent is selected from the group consisting of tetrahydrofuran, methyl tetrahydrofuran, dioxane and diethyl ether and mixtures thereof.

7. The method of claim 5 wherein the alkyllithium compound is a butyllithium and the complexing reagent is tetrahydrofuran.

8. The method of claim 1 wherein said non-destructive hydrogenation is carried out over nickel on Kieselguhr at 180° to about 250° C. and 600 psi hydrogen.

9. The method of claim 1 wherein the resultant synthetic hydrocarbon fluids have a viscosity ranging from about 5 to about 150 cS at 100° C.

10. The method of claim 1 wherein the resultant synthetic hydrocarbon fluids have traction coefficients ranging from about 0.090 to about 0.120 at 90° C. and 400 Kpsi contact pressure.

* * * * *